United States Patent [19]

Izumiya et al.

[11] Patent Number: 4,825,126

[45] Date of Patent: Apr. 25, 1989

[54] CERAMIC ENVELOPE DEVICE FOR HIGH-PRESSURE DISCHARGE LAMP

[75] Inventors: Hirotsugu Izumiya; Mikio Kariya, both of Nagoya, Japan

[73] Assignee: NGK Insulators, Ltd., Japan

[21] Appl. No.: 101,407

[22] Filed: Sep. 28, 1987

[30] Foreign Application Priority Data

Oct. 3, 1986 [JP] Japan ..... 61-152872[U]

[51] Int. Cl.[4] ..... H01J 17/18; H01J 61/36

[52] U.S. Cl. ..... 313/623; 313/624; 313/625; 313/281; 313/332

[58] Field of Search ..... 313/623, 624, 625, 281, 313/332, 631

[56] References Cited

U.S. PATENT DOCUMENTS

| | | | |
|---|---|---|---|
| 2,138,224 | 11/1938 | Barasch | 313/623 X |
| 2,731,581 | 1/1956 | Krefft | 313/343 |
| 3,892,993 | 7/1975 | Timmermans | 313/318 |
| 4,155,757 | 5/1979 | Hing | 252/512 X |
| 4,155,758 | 5/1979 | Evans et al. | 313/636 X |
| 4,507,584 | 3/1985 | Coaton et al. | 313/624 |
| 4,531,074 | 7/1985 | Nagy et al. | 313/623 X |
| 4,539,511 | 9/1985 | Denbigh et al. | 313/624 |
| 4,585,972 | 4/1986 | Hing | 313/694 X |

FOREIGN PATENT DOCUMENTS

| | | | |
|---|---|---|---|
| 0160445 | 11/1985 | European Pat. Off. | 313/624 |

*Primary Examiner*—David K. Moore
*Assistant Examiner*—Michael Horabik
*Attorney, Agent, or Firm*—Arnold, White & Durkee

[57] ABSTRACT

A ceramic envelope device for a high-pressure metal-vapor discharge lamp, including a translucent ceramic arc tube, a pair of electrically conducting cermet end caps closing opposite open ends of the ceramic arc tube, and having opposite inner surfaces facing each other, the end caps having a pair of inner holes formed in the opposite inner surfaces of the end caps, respectively, and a pair of discharge electrodes each provided in the form of a rod, having first ends supported in the inner holes in the end caps, respectively, and second ends which protrude from the opposite inner surfaces toward each other in a longitudinally inward direction in the ceramic arc tube. To fix each electrode in the corresponding hole by shrinkage fit with reduced thermal stresses during sintering of the end caps, at least one strand is inserted in each of the inner holes in the end caps, such that there exists an axial space between outer surfaces of the discharge electrode and the at least one strand, and an inner surface of the corresponding inner hole. Each strand has a diameter and a length smaller than those of the rod of the electrode.

10 Claims, 2 Drawing Sheets

CERAMIC ENVELOPE DEVICE FOR HIGH-PRESSURE DISCHARGE LAMP

BACKGROUND OF THE INVENTION

1. Field of the Invention

The present invention relates generally to a ceramic envelope device for use in a high-pressure discharge lamp (hereinafter referred to as "HID lamp"; "HID" representing High Intensity Discharge), and in particular to a pair of closure discs in the form of electrically conducting cermet end caps which close the opposite open ends of a translucent ceramic arc tube to form a gas-tight envelope of the envelope device. More particularly, the invention is concerned with a construction for partially embedding discharge electrodes and electrical lead members in the cermet end caps.

2. Discussion of Prior Art

In the art of such HID lamps using a translucent ceramic tube, a pair of electrically conducting discs (known as end caps) are used to close the opposite open ends of the translucent ceramic tube. Examples of such closure end caps are disclosed in U.S. Pat. No. 4,155,758. Such closure discs are formed of an electrically conducting cermet prepared by mixing, for example, particles of tungsten with particles of aluminum oxide, and sintering the mixture. The electrically conducting cermet end caps support a pair of tungsten electrodes at their opposite inner surfaces defining the length of the interior of the ceramic envelope, such that the electrodes protrudes from the inner surfaces of the end caps towards each other. Additionally, power-supply lead rods or contact rods are connected or fixed to the outer surfaces of the cermet end caps by suitable methods, so that electric power is applied to the pair of opposed tungsten electrodes through the contact rods and through the cermet end caps.

Such cermet end caps have been advantageously employed, for example, in high-pressure sodium lamps, because the cermet end caps permit the use of inexpensive tungsten electrodes in place of expensive niobium electrodes. It is further recognized that the cermet end caps have been used also advantageously for so-called metal halide lamps which have translucent ceramic tubes charged with a suitable metal halide together with mercury and rare gas, because the cermet exhibits relatively high corrosion resistance to metal halides.

However, such a cermet end cap has a tendency to crack due to an excessive degree of shrinkage of its green body during a sintering process, in which an electrode and a power-supply lead member are partially embedded in the sintered cermet end cap. The green body for the cermet end cap also suffers from cracking due to a large difference in thermal expansion coefficient between the material of the cermet end cap and the materials of the electrode and lead member. Such cracks in turn cause the translucent ceramic tube to leak, thereby lowering its luminous flux and even resulting in the HID lamp failing to function.

In the light of the above inconveniences, the present inventors developed a ceramic envelope device as disclosed in co-pending patent application, Ser. No. 794,767 filed on Nov. 4, 1985, which issued as U.S. Pat. No. 4,742,269 wherein electrodes and/or lead members partially embedded in the end caps are formed of twisted metallic wires. The use of the twisted wire electrodes and/or lead members on the end caps for HID lamps has been shown effective in eliminating cracking of the conducting cermet closure discs or end caps, and thereby preventing leaking of the translucent ceramic tube of the HID lamp.

A continuing investigation by the present inventors has revealed that the arrangement employing twisted metal wires as electrodes and lead members has something to be improved. Stated more specifically, the use of a plurality of metallic strands that are twisted together into a twisted wire will cause the tip of the formed electrode, for example, to be heated to such a high temperature as to induce consumption of the electrode tip, i.e., the free end of the twisted wire. Thus, the inner wall surface of the ceramic tube tends to be easily blackened, and the luminous flux may be accordingly lowered.

SUMMARY OF THE INVENTION

The present invention was completed in the light of the above situations in the prior art, and as a result of the inventors' investigation indicated above. It is therefore an object of the present invention to provide a ceramic envelope device for a high-pressure metal-vapor discharge lamp, which is effectively protected from blackening of its translucent ceramic tube during service, as well as cracking of the cermet end caps and leaking of the ceramic tube.

The above object may be attained according to the principle of the present invention, which provides a ceramic envelope device for a high-pressure metal-vapor discharge lamp, including a translucent ceramic arc tube, a pair of electrically conducting cermet end caps closing opposite open ends of the ceramic arc tube, and having opposite inner surfaces facing each other, the end caps having a pair of inner holes formed in the opposite inner surfaces of the end caps, respectively, and a pair of discharge electrodes each provided in the form of a rod, having first ends supported in the inner holes in the end caps, respectively, and second ends which protrude from the opposite inner surfaces toward each other in a longitudinally inward direction in the ceramic arc tube. At least one strand is provided in each of the inner holes in the end caps, so as to fix each electrode rod in the corresponding inner hole, such that there exists a radial space between outer surfaces of the electrode rod and the at least one strand, and an inner surface of the corresponding inner hole. The radial space extends in the direction of length of the strand and electrode rod. Each strand has a diameter and a length smaller than those of the electrode rod.

In the high-pressure metal-vapor discharge lamp incorporating the ceramic envelope device of the invention constructed as described above, the thin strand or strands provided within each inner hole formed in each end cap closing the corresponding end of the ceramic arc tube permit the end cap and the electrode rod to be thermally deformed during sintering of the envelope device, and consequently provide for a sound shrinkage fit of the electrode rods in the corresponding inner holes in the end caps, without cracking of the end caps due to excessive thermal stresses. Thus, the use of the strands is effective to prevent leaking of the ceramic arc tube due to otherwise possible cracking of the end caps during manufacture of the envelope device, and therefore avoid blackening of the wall surface of the ceramic arc tube, assuring a high degree of its luminous flux and improved operating reliability of the lamp. This is an important industrial significance of the present invention.

According to one feature of the invention, the diameter of each strand is within a range between 1/10 and 8/10 of the diameter of the electrode rod.

According to another feature of the invention, each strand is substantially entirely accommodated within the corresponding inner hole.

Accordig to a further feature of the invention, the pair of inner holes have a substantially circular cross sectional shape prior to sintering of the end caps.

In accordance with a still further feature of the invention, each electrical lead member supported in an outer hole formed in each end cap may be provided with a similar strand or strands, in order to assure a shrinkage fit of the electrical lead member in the corresponding outer hole, without crackingn of the end cap. In this case, too, a space exists between outer surfaces of the electrical lead member and the strand or strands in the outer hole, and an inner surface of the outer hole. Each strand in the outer hole in each end cap has a diameter and a length which are smaller than those of the electrical lead member.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

To further clarify the concept of the present invention, the presently preferred embodiments of the invention will be described in detail, by reference to the accompanying drawings.

Figure 1:
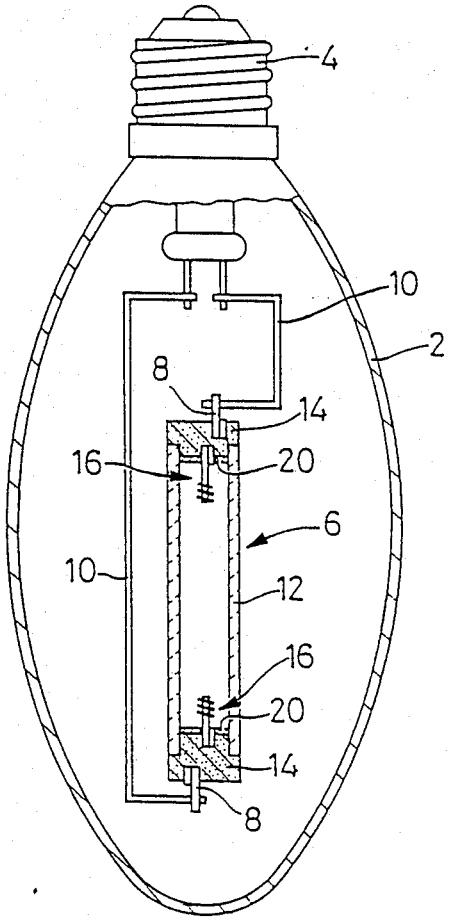
FIG. 1 is a schematic elevational view partly in cross section of an HID lamp incorporating one embodiment of a ceramic envelope device of the present invention which includes a pair of electrically conducting end caps closing the opposite ends of a translucent ceramic tube.

Referring first to FIG. 1, there is schematically shown a complete assembly of an HID lamp which incorporates a ceramic envelope device generally indicated at 6. In the figure, reference numeral 2 designates a bulbiform translucent jacket which is generally made of a glass or similar material. This translucent jacket 2 is closed at its open end by a base 4. The jacket 2 and the base 4 cooperate with each other to form a gas-tight enclosure which is charged with a suitable inert gas such as nitrogen, or maintained under vacuum. As is well known in the art, electric power applied to the base 4 is supplied, via electrical conductor members 10, 10, to electrically conducting lead members 8, 8 which are disposed at the opposite ends of the ceramic envelope device 6 accommodated in the translucent jacket 2.

The ceramic envelope device 6 includes a translucent ceramic arc tube 12 and a pair of closure discs in the form of cermet end caps 14, 14 which are secured to the opposite open ends of the ceramic arc tube 12 so as to maintain gas-tightness of the ceramic envelope 6. The translucent ceramic arc tube 12 is a tubular member made of a alumina or some other ceramic material as disclosed in U.S. Pat. Nos. 3,026,210 and 3,792,142. The end caps 14, 14 are formed from an electrically conducting material. Each of the lead members 8, 8 is embedded at its one end in an outer portion of the corresponding end cap 14. On the other hand, a pair of discharge electrodes 16, 16 are embedded at their one end in an inner portion of the corresponding end caps 14, 14. The ceramic arc tube 12 of the gas-tight ceramic envelope device 6 is charged with a suitable gas, and a suitable metal compound of said metal, which are selected depending upon the specific type of HID lamp, from the standpoints of radiant efficacy, color-rendering properties, etc. In the case of a high-pressure sodium lamp, for example, the arc tube 12 is charged with metallic sodium, mercury and rare gas. In a metal halide lamp, the arc tube 12 is charged with a metal halide (such as dysprosium iodide, thallium iodide, sodium iodide, indium iodide, etc.), together with mercury and rare gas.

The principle of the present invention is applied to the electrodes 16, 16 and the lead members 8, 8 which are partially embedded in the electrically conducting end caps 14, 14 which close the opposite ends of the translucent ceramic arc tube 12. One form of the electrodes 16 and the lead members 8 is illustrated in FIGS. 2 and 4.

Figure 2:
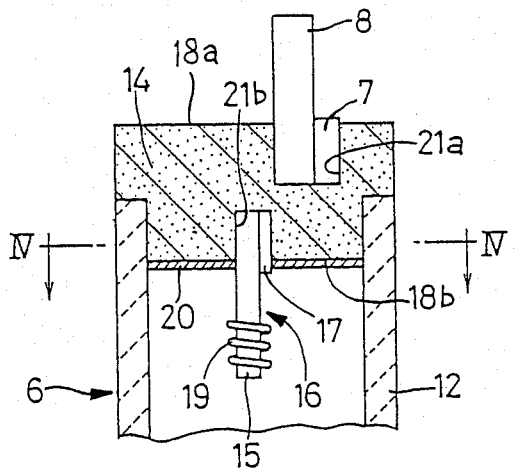
FIG. 2 is an enlarged fragmentary elevational view partly in longitudinal cross section, showing one longitudinal end portion of the envelope device of the HID lamp of FIG. 1.
Figure 4:
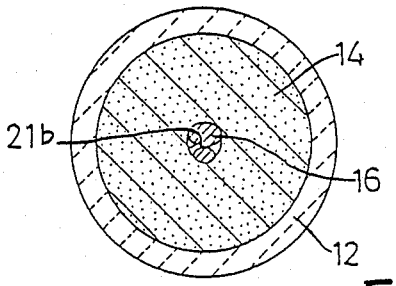
FIG. 4 is a transverse cross sectional view of the end cap of FIG. 2, taken along line IV–IV of FIG. 2.

Described more specifically referring to FIGS. 2 and 4, each electrically conducting end cap 14 is secured to a corresponding end of the translucent ceramic arc tube 12 of the ceramic envelope device 6, by means of a shrinkage fit upon sintering of the envelope device. The end cap 21 has an outer hole **21*a* formed in its outer surface 18*a*, and an inner hole 21*b* formed in its inner surface 18*b*. The inner hole 21*b* is located substantially in the center of the arc tube 12. These holes 21*a* and 21*b* have a circular cross sectional shape. The lead member 8 has a suitable diameter, and is made of a suitable member such as tungsten. This lead member 8 is embedded at its fixed end portion in the outer hole 21*a*, so as to protrude from the outer surface 18*a* in a longitudinally outward direction of the arc tube 12. Further, a single thin strand 7 is substantially entirely embedded in the outer hole 21*a*, in parallel relationship with the lead member 8. On the other hand, the electrode 16 consists of a rod 15 made of tungsten, for example, and a single thin strand 17. The electrode 16 is embedded at its fixed end portion in the inner hole 21*b*, with the thin strand 17 substantially entirely embedded in the hole 21*b* in parallel with the rod 15. The electrode 16 protrudes from the inner surface 18*b* in a longitudinally inward direction of the arc tube 12, so that the rod 15 is exposed a suitable length to the interior of the arc tube 12. The rod 15 has a coil 19** wound on the exposed free end portion, as well known in the art.

The thin strands 7, 17 are generally formed of the same metallic materials as those of the lead member 8 and the rod 15 of the electrode 16, for example, tungsten. While each of the lead member 8 and the electrode 16 is provided with the only one thin strand 7, 17 in the present embodiment, it is possible to arrange a plurality of strands around the periphery of the lead member 8 or the rod 15.

The inner surface 18*b* of the end cap 14 from which the electrode 14 protrudes is covered by an arc-back preventive insulating layer 20 having a suitable thickness. While the insulating layer 20 covers the entire area of the inner surface 18*b* in the illustrated embodiment, only a selected area of the inner surface 18*b* may be covered by the layer 20.

Figure 5:
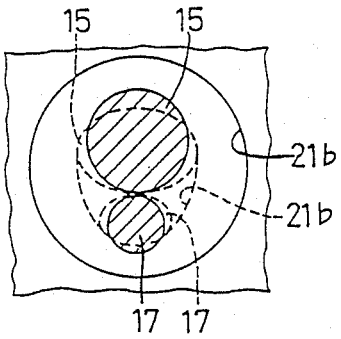
FIG. 5 is a transverse cross sectional illustration, indicating relationships between an electrode and a hole in the end cap of FIG. 2, before and after a shrinkage fit of the electrode in the hole, wherein solid lines represent the relationship before the shrinkage fit, while broken lines represent the relationship after the shrinkage fit.

The rod 15 of the electrode 16, and the lead member 8 are shrink-fitted in the corresponding round holes 21*b*, 21*a*. Namely, prior to sintering of a green body of the end cap 14, the rod 15 and the lead member 8 are positioned in the holes 21*b*, 21*a* in the end cap 14, together with the thin strands 17, 7, as indicated in solid lines in FIG. 5 by way of example. Then, the green body of the end cap 14 is fired at a sintering temperature. As a result, the round hole 21*b* (21*a*) in the end cap 14, the rod 15 (lead member 8) and the thin strand 17 (7) undergo thermal deformation in the transverse cross sectional plane of FIG. 5, as indicated in broken lines in the figure. In this manner, the rod 15 and the lead member 8 are secured in the respective holes 21*b*, 21*a* by means of shrinkage fit, with good electrical contact with the end cap 14, and with a sufficient shrink-fit force, while reducing or ameliorating thermal stresses between the end cap 14 and the rod 15 or lead member 8.

Figure 3:
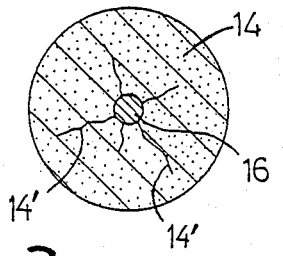
FIG. 3 is a transverse cross sectional view, illustrating cracks which occurs in an end cap in which a known electrode in the form of a rod is partially embedded.

The above manner of fixing the lead member 8 and the electrode 16 is advantageous over a conventionally used manner as shown in FIG. 3, in which the electrode member 16 fills the entire volume of the corresponding hole, whereby stresses which may arise due to contraction of the green end cap 14 cannot be suitably absorbed. Thus, the conventional arrangement suffers from cracks 14' occuring in the end cap 14. In the end cap 14 of the illustrated enveloped device 6 prior to the sintering process, there exists a sufficient radial space between the outer surfaces of the rod 15 and strand 17 of the electrode 16, and the inner surface defining the inner hole 21*b*, as indicated in solid lines in FIG. 5. Since the strand 17 is straight, the radial space extends continuously in the direction of length of the strand 17, that is, in the axial direction of the arc tube 12. In this arrangement, the rod 15, strand 17 and end cap 14 may undergo thermal deformation so as to effectively reduce otherwise excessive thermal stresses due to contraction of the end cap 14. The end cap 14 and the electrode 16 after the thermal deformation are depicted in FIG. 4.

Further, since the thin strand 17 embedded in the inner hole 21*b* in juxtaposed relationship with the fixed end portion of the rod 15 of each electrode 16 has a smaller length than the rod 15, a discharge or generation of an arc can occur between the free ends of the opposite rod-like bodies 15 which have a comparatively large diameter. Hence, unlike electrodes consisting of twisted metal strands, the rods 15 of the electrodes 16 are maintained at a relatively low temperature at their free ends, whereby the conventionally experienced blackening of the wall of the arc tube may be effectively ameliorated.

The diameters of the rods 15 of the electrodes 16, and the lead members 8 are generally selected within a range of about 0.4–1.5 mm, which is almost similar to the diameter range of the conventionally used rod-like electrodes and lead members. The thin strands 7, 17 have diameters smaller than those of the rods 15 and the lead members 8, preferably about 1/10 to 8/10 of the diameters of the rods 15 and lead members 8. If the strands 7, 17 are excessively thin, they are not effective to prevent cracking of the end caps 14. If the diameters of the strands 7, 17 exceed 8/10 of those of the diameters of the rods 15 and lead members 8, there is left an excessive volume of space between the inner surface of the round hole 21*a*, 21*b* and the outer peripheries of the electrode 16 (lead member 8 and strand 7), whereby an area of contact of the electrode 16 or lead member 8 with the end cap 14 is reduced, and the heat capacity of the electrode 16 is increased, leading to a poor starting of the HID lamp. It is desirable that the length of the strand 17 be smaller than that of the rod 15, while the length of the strand 7 be substantially equal to that of the lead member 8 for easier manufacture of the ceramic envelope device. In the case of the strand 17, the length is preferably selected so that its free end does not reach the coil 19. More preferably, the length of the strand 17 is selected so that the strand 17 does not protrude from the insulating layer 20, or so that the strand 17 is accommodated within the hole 21*b*.

The use of the thin strands 7, 17 within the holes 21*a*, 21*b* according to the present invention will avoid cracking and consequent leaking of the end caps 14, 14 which would otherwise take place due to differences in thermal expansion coefficient between the end caps and the conventional rod-like electrodes and lead members. Thus, the strands 7, 17 are effective to eliminate or minimize the conventionally encountered problems, i.e., blackening of the wall surface of the translucent arc tube, and consequent decline in the luminous flux, or failure of the lamp.

The electrically conducting end caps 14, 14 of the instant ceramic envelope 6 are made of a material selected from among various known electrically conductive materials. Generally, it is recommended that the end caps 14, 14 are formed from an electrically conductive material whose coefficient of thermal expansion is intermediate between that of the material of the translucent ceramic arc tube 12, and that of the refractory metal of the electrode 16 (rod 15) and lead member 8. For example, a composite material consisting of metallic tungsten or metallic molybdenum and aluminum oxide, or tungsten carbide or tungsten boride may be used for the end caps 14, 14.

Further, a suitable electrically insulating material may be used for the insulating layer 20 covering the inner surface 18*b* of each end cap 14 in which the electrode 16 is partially embedded.

While the illustrated preferred embodiment is adapted such that both of the rod 15 and the lead member 8 are provided with the respective strands 17, 7, the object of the present invention may be achieved, provided that at least the thin strand 17 is used for the rod 15 which serves as a body of the electrode 16.

In the instant ceramic envelope 6 which has been described, the translucent arc tube 12 is closed by the end caps 14 in which at least the electrodes 16 are embedded together with the thin strands 17, according to the principle of the present invention. This ceramic envelope 6 may be used for a high-pressure sodium lamp, a metal halide lamp, or other HID lamps.

Although the present invention has been described in its presently preferred typical embodiment, it is to be understood that the invention is by no means limited to the precise details of the embodiment illustrated and described above, but the invention may be embodied with various changes, modifications and improvements which may occur to those skilled in the art, without departing from the spirit of the invention.

Figure 6:
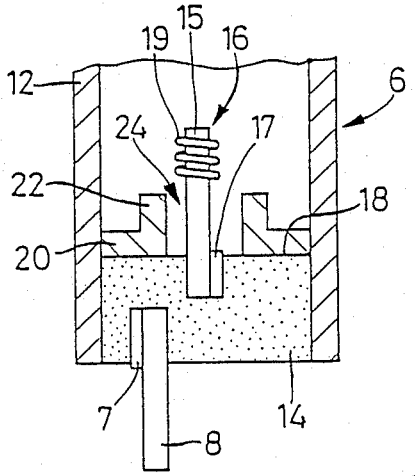
FIG. 6 is an enlarged fragmentary elevational view in longitudinal cross section of a longitudinal end portion of another embodiment of the envelope device of the invention.

For instance, the electrically insulating layer 20 may be formed with a cylindrical central protruding portion 22, as shown in FIG. 6, such that an annular gap 24 is defined between the outer periphery of the electrode 16 and the inner surface of the protruding portion 22. In this case, the central protruding portion 22 which protrudes from the inner surface; of the annular peripheral portion of the insulating layer 20 serves to protect the central portion of the end cap 14 and the insulating layer 20 around the electrode 16, against corrosion due to a liquid phase of condensed metal halide, thereby making it possible to prolong the life expectancy of the lamp.

What is claimed is:

1. A ceramic envelope device for a high-pressure metal-vapor discharge lamp, comprising:

a translucent ceramic arc tube;

a pair of electrically conducting cermet end caps closing opposite open ends of said ceramic arc tube, and having opposite inner surfaces facing each other, said pair of end caps having a pair of inner holes formed in said opposite inner surfaces, respectively;

a pair of discharge electrodes each provided in the form of a rod, having first ends supported in said pair of inner holes in said pair of end caps, respectively, and second ends which protrude from said opposite inner surfaces toward each other in a longitudinally inward direction in said ceramic arc tube; and at least one substantially straight strand provided in each of said pair of inner holes in said end caps substantially parallel to each discharge electrode, so as to fix each discharge electrode in each corresponding inner hole, such that at least one radial space exists between outer surfaces of each discharge electrode and said at least one strand, and an inner surface of said corresponding inner hole, said at least one radial space extending in an axial direction generally parallel to the length of said electrode and said strand, each of said at least one strand having a diameter which is smaller than that of said rod.

2. A ceramic envelope device according to claim 1, wherein said diameter of said each strand is within a range between 1/10 and 8/10 of the diameter of said rod.

3. A ceramic envelope device according to claim 1, wherein said each strand is substantially accommodated within said corresponding inner hole.

4. A ceramic envelope device according to said claim 1, wherein said pair of inner holes have a substantially circular cross sectional shape prior to sintering of said pair of end caps.

5. A ceramic envelope device according to claim 1, wherein said at least one strand provided in said each inner hole consists of a single strand.

6. A ceramic envelope device according to claim 1, wherein said pair of end caps have a pair of outer surfaces each having an outer hole for supporting an electrical lead member, at least one substantially straight strand being provided in said outer hole substantially parallel to each lead member so as to fix said electrical lead member in said outer hole, such that at least one radial space exists between outer surfaces of said electrical lead member and said at least one strand in said outer hole, and an inner surface of said outer hole, said at least one radial space extending in an axial direction generally parallel to the length of said electrical lead member and said strand, each of said at least one strand in said outer hole having a diameter which is smaller than that of said electrical lead member.

7. A ceramic envelope device according to claim 1, wherein each of said at least one strand has a length which is smaller than that of said rod.

8. A ceramic envelope device according to claim 6, wherein each of said at least one strand has a length which is smaller than that of said electrical lead member.

9. A ceramic envelope device for a high-pressure metal-vapor discharge lamp, comprising:

a translucent ceramic arc tube;

a pair of electrically conducting cermet end caps closing opposite open ends of said ceramic arc tube, and having opposite inner surfaces facing each other and opposite outer surfaces opposing each other, said pair of end caps having a pair of inner holes formed in said opposite inner surfaces, respectively, and a pair of outer holes formed in said opposite outer surfaces, respectively;

a pair of discharge electrodes, each provided in the form of a rod, having first ends supported in said pair of inner holes and second ends which protrude from said opposite inner surfaces toward each other in a longitudinally inward direction in said ceramic arc tube.

a pair of electrical lead members having first ends supported in said pair of outer holes and second ends which protrude from said opposite outer surfaces away from each other in a longitudinally outward direction from said ceramic arc tube; and at least one substantially straight strand provided in each pair of outer holes substantially parallel to each electrical lead member so as to fix each of said pair of electrical lead members in each corresponding outer hole, such that at least one radial space exists between outer surfaces of each electrical lead member and said at least one strand, and an inner surface of said corresponding outer hole, said at least one radial space extending in an axial direction generally parallel to the length of said electrical lead member and said strand, each of said at least one strand having a diameter which is smaller than that of said electrical lead member.

10. A ceramic envelope device according to claim 9, wherein each of said at least one strand has a length which is smaller than said electrical lead member.

* * * * *